United States Patent [19]

Olmstead

[11] Patent Number: 4,566,965

[45] Date of Patent: Jan. 28, 1986

[54] REMOVAL OF NITROGEN AND SULFUR FROM OIL-SHALE

[75] Inventor: William N. Olmstead, Berkeley Heights, N.J.

[73] Assignee: Exxon Research & Engineering Company, Florham Park, N.J.

[21] Appl. No.: 630,892

[22] Filed: Jul. 13, 1984

Related U.S. Application Data

[63] Continuation-in-part of Ser. No. 453,729, Dec. 27, 1982, abandoned.

[51] Int. Cl.[4] ..... C10G 1/00; C10G 1/02

[52] U.S. Cl. ..... 208/11 R; 208/8 R; 208/254 R; 208/208 R; 208/208 M

[58] Field of Search ..... 208/8 R, 11 R, 254 R, 208/208 M, 208 R; 44/15 R; 201/17

[56] References Cited

U.S. PATENT DOCUMENTS

| | | | |
|---|---|---|---|
| 1,703,192 | 2/1929 | Hampton | 208/11 R |
| 3,238,038 | 3/1966 | Hunter | 75/7 |
| 3,516,787 | 6/1970 | Nordstrand | 423/127 |
| 4,176,042 | 11/1979 | Fahlstrom | 208/11 LE |

*Primary Examiner*—John Doll
*Assistant Examiner*—Chung K. Pak
*Attorney, Agent, or Firm*—Henry E. Naylor

[57] ABSTRACT

Disclosed is a method for enhancing the removal of nitrogen and sulfur from oil-shale which process comprises heating the oil-shale with a basic solution comprised of one or more hydroxides of the alkali metal and alkaline-earth metals.

7 Claims, No Drawings

REMOVAL OF NITROGEN AND SULFUR FROM OIL-SHALE

CROSS-REFERENCE TO RELATED APPLICATIONS

This application is a continuation-in-part of U.S. Ser. No. 453,729, filed Dec. 27, 1982 now abandoned.

FIELD OF THE INVENTION

The present invention relates to enhancing the removal of nitrogen and sulfur from oil-shale by treating the oil-shale with an alkali or alkaline-earth metal base solution at a temperature from about 50° C. to about 350° C.

BACKGROUND OF THE INVENTION

Oil-shale, one of the leading sources under investigation for the production of synthetic fuels, may play a leading role in the energy future of the United States. The primary reason for the growing importance of oil-shale, as well as coal, is the rapid depletion of known petroleum and natural gas reserves. These known reserves are being depleted at a faster rate than the rate of discovering new reserves. As the era of petroleum growth draws to a close, the world's energy mix will have to change. Transition energy sources will be needed as a bridge between petroleum and the potentially unlimited energy sources of the future; such sources being, for example, solar power and nuclear fusion. Owing to their great abundance, coal and oil-shale are perceived as the keystones of such a bridge. Consequently, a great deal of research and development is presently in progress to provide economical ways of converting these solid resources to valuable liquids and gases.

Generally, oil is produced from oil-shale by heating the oil-shale in either a fixed or moving bed reactor at a temperature from about 450° C. to 550° C. for a long enough time to convert the organic matter to gas, oil, and residual carbon on spent shale.

Although myriad other process exist for obtaining oil from oil-shale, all of these processes result in: (i) a shale-oil which faces severe problems in up-grading because of a relatively high concentration of nitrogen, and (ii) a spent shale having an unacceptable level of nitrogen, sulfur, or both. This nitrogen and sulfur could generate undesirable levels of nitrogen and sulfur oxide pollutants if the spent shale is combusted for its fuel value.

SUMMARY OF THE INVENTION

In accordance with the present invention there is provided a method for removing nitrogen and sulfur from oil-shale. The method comprises: (a) contacting the oil-shale with an aqueous base solution containing at least a stoichiometric amount of one or more alkali metal or alkaline-earth metal hydroxides, at a temperature from about 50° C. to about 350° C., and at pressures sufficient to maintain the solution in liquid form, and (b) separating the effluents from the treated oil-shale wherein the resulting liquid effluent contains nitrogen moieties and sulfur moieties from the oil-shale and any resulting gaseous effluent contains nitrogen moieties from the oil-shale.

In a preferred embodiment of the present invention, the oil-shale is contacted with a solution of one or more alkaline-earth hydroxides, at a temperature from about 50° C. to about 100° C., and at atmospheric pressure.

DETAILED DESCRIPTION OF THE INVENTION

The general composition and characteristics of oil-shale are well-known and therefore will not be described in detail herein. For practical purposes, the oil-shale should contain at least 10, preferably at least about 20, and more preferably between about 25 and 75 gallons of oil per ton of oil-shale, by Fischer Assay.

Although the present invention may be practiced on any known oil-shale, some oil-shales, such as Rundle oil-shale, have been found to have a higher proportion of its nitrogen in a chemical form which enhances its removal with an alkali or alkaline-earth metal hydroxide solution.

Although the particle size of the oil-shale is not critical, it is preferred for convenience of handling, that the oil-shale be crushed to a particle size having an average diameter of less than about 1 inch; preferably less than about ½ inch. The diameter of the particles as referred to herein is the smallest size of the screen opening through which particles of the designated "diameter" will pass.

The crushed oil-shale is fed into a reaction vessel and contacted with the base solution at a temperature from about 50° C. to about 350° C., preferably from about 75° C. to about 300° C. If temperatures greater than 100° C. are employed, elevated pressures, from about 1 to about 165 atmospheres, will be generated in the closed reaction vessel.

The concentration of base employed herein is at least a stoichiometric amount, based on the total amount of nitrogen and sulfur present in the oil-shale. The volume of base solution employed should be a sufficient amount, that is, an amount sufficient to form a two phase system (liquid and solid) with the crushed oil-shale. Preferably, up to about 50 parts of base solution per part of oil-shale by weight is employed. If 50 parts, or more, by weight of base solution to oil-shale is employed, then the concentration of base must be substantially more than a stoichiometric amount for the reaction to proceed at an appreciable rate.

It is important that the base be in solution, otherwise it will not be capable of removing nitrogen and sulfur from the oil-shale as evidenced in the examples to follow.

By practice of the present invention, nitrogen of the oil-shale will be converted to ammonia and will be removed in both the liquid and gaseous effluents resulting from the present process. Sulfur moieties present in the oil-shale will be removed in the hydroxide solution. Any suitable method can then be employed to remove ammonia moieties, sulfur moieties, or both, from the effluent streams. The hydroxide solution can then be regenerated and recycled to the reaction vessel.

One non-limiting method for removing ammonia from the liquid effluent would be to bubble an inert gas through the water effluent, thereby removing the ammonia in the evolving gases. A non-limiting method for removing both ammonia and sulfur from the liquid effluent would be to bubble carbon dioxide through the liquid effluent.

The treated oil-shale, which now contains a lower level of both nitrogen and sulfur, can now be passed along to a high temperature conversion process for converting a substantial amount of the organic material of the oil-shale to predominantly shale-oil. One such conversion, or retorting process which may be employed herein comprises heating the oil-shale, either alone or with a solvent, at a temperature from about 450° C. to about 550° C. for an effective amount of time in an appropriate type reactor. Non-limiting examples of appropriate types of reactors which may be employed include fixed, moving, and fluid bed reactors. The term, effective amount of time, means for a time long enough to convert a substantial portion of the organic material of the oil-shale to predominantly liquids.

Spent shale, which is the solid residue resulting from a retorting process, usually contains up to 3 percent by weight, or more, of carbon. This spent shale can be used as a combustible fuel source at the plant. By the practice of the present invention, the resulting spent shale will have a lower nitrogen and sulfur content than usual, and consequently, when combusted, will generate lower levels of nitrogen oxide and sulfur oxide pollutants. Furthermore, the shale-oil resulting from oil-shale which has been treated in accordance with the present invention, will contain less nitrogen and sulfur than it would otherwise contain. Therefore the shale-oil may require only a relatively mild upgrading.

The basic solution which may be employed in the practice of the present invention may be comprised of one or more hydroxides of a metal selected from Group IA and Group IIA of the Periodic Table of the Elements. These groups are also known as the alkali metals and the alkaline-earth metals, respectively.

It may be preferred to use the alkaline-earth metals primarily because of their relatively noncorrosive nature.

Comparative Examples A and B

For Comparative Example A, 3 g of Rundle oil-shale was placed into a 300 cc autoclave reactor and heated to 250° C. in about 60 minutes and held at that temperature for another 30 minutes. Gaseous effluent was continuously removed once the temperature of 250° C. was reached. This procedure was also followed for Comparative Example B except Colony oil-shale was used. The results of nitrogen and sulfur removal are shown in Table I below.

EXAMPLES 1-6

For examples 1, 2, 4 and 5, 3 g of oil-shale and 150 g of 0.1M NaOH solution were placed in a 300 cc autoclave reactor. For examples 3 and 6, 3 g of oil-shale, 150 g of water and 0.9 g of CaO was placed in a 300 cc autoclave reactor. In each case, the autoclave reactor was heated to 275° C. for examples 2 and 5, and to 250° C. for the other examples all in about 60 minutes. The reactor was then cooled to below 100° C. and the liquid effluent separated from the treated oil-shale. For examples 1, 2, 4 and 5, residual NaOH, in the treated oil-shale was removed by Soxhlet extraction with water. The results of nitrogen and sulfur removal are shown in Table I below.

Comparative Examples C-F

These examples were performed by intimately mixing 3 g of oil-shale with either 0.9 g of crushed CaO or 0.6 g of crushed NaOH. The particular oil-shale and other conditions are set forth in Table I below. The mixture was placed into a 300 cc autoclave reactor and heated to 250° C. in about 60 minutes and held at that temperature for another 30 minutes. These examples demonstrate that base, in solid form, is unsuitable for use in the present invention.

TABLE I

REMOVAL OF NITROGEN AND SULFUR

| Example | $H_2O$ | Base | Shale | Temp °C. | Wt. % Removed (a) N | Wt. % Removed (a) S |
|---|---|---|---|---|---|---|
| Comp. Ex. A | No | None | Rundle | 250 | 7 ± 1 | 4 ± 1 |
| Comp. Ex. C | No | NaOH | Rundle | 250 | 3 | 0 |
| 1 | Yes | NaOH | Rundle | 250 | 51 ± 5 | 57 ± 5 |
| 2 | Yes | NaOH | Rundle | 275 | 59 ± 7 | 80 ± 5 |
| Comp. Ex. E | No | CaO | Rundle | 250 | 8 | 1 |
| 3 | Yes | CaO | Rundle | 250 | 39 | 18 |
| Comp. Ex. B | No | None | Colony | 250 | 2 ± 1 | 7 ± 2 |
| Comp. Ex. D | No | NaOH | Colony | 250 | 0 | 0 |
| 4 | Yes | NaOH | Colony | 250 | 28 ± 5 | 65 ± 5 |
| 5 | Yes | NaOH | Colony | 275 | 35 ± 5 | 71 ± 5 |
| Comp. Ex. F | No | CaO | Colony | 250 | 0 | 4 |
| 6 | Yes | CaO | Colony | 250 | 31 | 30 |

(a) = based on the total weight of nitrogen and sulfur in the oil-shale

Comparative Example G 1.2 g of Rundle oil-shale (10/40 mesh) and 20 ml of water were placed in a round bottomed Pyrex flask fitted with a reflux condenser and heated to 100° C. and held at that temperature for 24 hours. The flask and its contents were then allowed to cool and the liquid effluent was separated from the treated oil-shale. The results of nitrogen removal are found in Table II below.

EXAMPLES 7-12

Various samples of both Rundle and Colony oil-shale were treated with various amounts and concentration of NaOH solutions or solid CaO, which is only partially soluble at these conditions. Each sample was heated to and held at 100° C. with the respective solution for various times. The liquid effluent was separated from the treated oil-shale. The conditions for each sample, as well as the resulting nitrogen removed, are found in Table II below.

TABLE II

| Example | g. Shale | ml/M NaOH Solution | ml $H_2O$/g CaO | Time (Hours) | Wt. % Removed N | Wt. % Removed S |
|---|---|---|---|---|---|---|
| Comp. Ex. G | 1.2 g Rundle | — | | 24 | 0 | 2 |
| 7 | 1.4 g Rundle | 20 ml/1 M | | 5 | 28 | 3 |
| 8 | 1.5 g Rundle | 30 ml/1 M | | 24 | 33 | 0 |
| 9 | 2.1 g Rundle | — | 21/0.1 | 24 | 12 | 10 |
| 10 | 2.4 g Colony | 25 ml/1 M | | 24 | 5 | — |
| 11 | 2.5 g Colony | 25 ml/6 M | | 24 | 18 | — |
| 12 | 2.2 g Colony | — | 21/0.1 | 24 | 8 | 10 |

The above table shows that a base solution, such as NaOH and $Ca(OH)_2$, is effective for enhancing the removal of nitrogen from oil-shale. The table also shows that the present invention is more effective for some types of oil-shale, such as Rundle oil-shale.

What is claimed is:

1. A process for enhancing the removal of nitrogen and sulfur from oil-shale, which process comprises:

(a) contacting the oil-shale with a sufficient amount of an aqueous base solution comprised of at least a stoichiometric amount of one or more alkali metal or alkaline-earth metal hydroxides based on the total amount of nitrogen and sulfur present in the oil-shale, and in an amount sufficient to form a two phase liquid, solid system, at a temperature from about 50° C. to about 350° C., and at pressures sufficient to maintain the solution in liquid form, (b) separating the effluents from the treated oil-shale, wherein the resulting liquid effluent contains nitrogen moieties and sulfur moieties from the oil-shale and any resulting gaseous effluent contains nitrogen moieties from the oil-shale, and (c) converting organic material of the treated oil-shale to shale-oil at a temperature from about 450° C. to about 550° C.

2. The process of claim 1 wherein the solution is comprised of sodium hydroxide or potassium hydroxide.

3. The process of claim 1 wherein the solution is comprised of calcium hydroxide.

4. The process of claim 1 wherein the temperature is from about 75° C. to about 300° C.

5. The process of claim 3 wherein the temperature is from about 75° C. to about 300° C.

6. The process of claim 2 wherein 50 or less parts of base solution per part of oil-shale, by weight, is employed.

7. The process of claim 5 wherein 50 or less parts of calcium hydroxide solution per part of oil-shale, by weight, is employed.

* * * * *